United States Patent [19]

Miyamoto et al.

[11] 4,129,377

[45] Dec. 12, 1978

[54] VARIABLE MAGNIFICATION COPYING APPARATUS

[75] Inventors: Koichi Miyamoto; Yoshikuni Tohyama, both of Tokyo; Seiji Sagara, Kawasaki; Yoshimasa Kimura, Kawasaki; Masato Ishida, Kawasaki, all of Japan

[73] Assignee: Canon Kabushiki Kaisha, Tokyo, Japan

[21] Appl. No.: 750,569

[22] Filed: Dec. 14, 1976

[30] Foreign Application Priority Data

Dec. 18, 1975 [JP] Japan ..... 50-151411

[51] Int. Cl.[2] ..... G03G 15/00

[52] U.S. Cl. ..... 355/14

[58] Field of Search ..... 355/7, 8, 14

[56] References Cited

U.S. PATENT DOCUMENTS

| | | | |
|---|---|---|---|
| 3,552,849 | 1/1971 | Limberger | 355/14 |
| 3,876,300 | 4/1975 | Washio et al. | 355/14 X |
| 3,930,725 | 1/1976 | Jones et al. | 355/14 |
| 4,009,957 | 3/1977 | Suzuki et al. | 355/14 |
| 4,026,647 | 5/1977 | Kanno et al. | 355/8 |

*Primary Examiner*—William M. Shoop

*Attorney, Agent, or Firm*—Fitzpatrick, Cella, Harper & Scinto

[57] ABSTRACT

A variable magnification copying apparatus includes optical scanning means for scanning an image original at a variable velocity in accordance with a copying magnification desired, a photosensitive drum movable at a predetermined velocity from an exposure station to an image transfer station, conveyor means for conveying copy medium to the image transfer station, detector means for generating a signal when the scanning means has scanned an edge of the image original or a portion thereof near the edge, and control means coupled to the detector means for controlling the conveyor means by the signal so as to ensure the image of the original to be copied with the leading edge thereof registered to the leading edge of the copy medium with respect to the direction of conveyance, irrespective of changes in magnification.

16 Claims, 10 Drawing Figures

VARIABLE MAGNIFICATION COPYING APPARATUS

BACKGROUND OF THE INVENTION

1. Field of the Invention

This invention relates to a variable magnification copying apparatus of the slit exposure type in which variable magnification copying is effected with a copy medium maintained at a predetermined velocity but with the velocity of optical scanning means varied.

2. Description of the Prior Art

In order to obtain two or more steps of copy magnification in a variable magnification copying apparatus of the slit exposure type, there is usually adopted a method of changing the velocity of the optical scanning means while maintaining the copy medium at a predetermined velocity. According to this method, variable magnification copying can be easily accomplished by using entirely the same factors as those for the 1× magnification copying in the processes such as charging and development of the photosensitive medium and in all the other driving and conveying mechanisms than the optical system. The scanning of an image original by the optical system is usually carried out in two alternative ways, one of which uses a movable optical system in which an illumination system, mirrors and the like are movable and the other uses an original carriage movable with respect to the optical system. However, the optical scanning means mentioned herein means one of the optical system and the original carriage which is movable. Usually, optical scanning means must be moved at a constant velocity as long as it optically scans an image original in the form of a slit. Therefore, a suitable preliminary running range is provided on the way to one edge of the image original so that before the optical scanning means illuminates said one edge of the image original, the optical scanning means may assume a constant velocity and a light source for illumination may assume its steady state condition.

Where variable magnification copying is effected by using the above-described method and for example, if the velocity of a copy medium is V, the velocity of the optical scanning means during the 1× magnification copying is of course equal to V, but the velocity of the scanning means during the N× magnification copying is V/N. Consequently, the time required for the optical scanning means to scan over the aforementioned preliminary running range differs from that required for the 1× magnification copying.

Thus, if copying is effected with the velocity of the optical scanning means alone varied but with the other conditions maintained identical to those for the 1× magnification copying, the copy image formed on the copy medium may lack a portion corresponding to the one edge of the image original or conversely, a large blank or unimaged area will exist on the copy medium before the one edge of the image original is copied, and this will sometimes result in an inconvenience that the other edge portion of the image original is left uncopied.

To correct the misregistration between the image original and the copy medium resulting from such change in magnification during the variable magnification copying, the following methods would occur to mind.

(1) With respect to the copy medium effecting a predetermined movement, the timing for starting the scanning of the optical scanning means is changed in accordance with each magnification desired;

(2) With respect to the copy medium effecting a predetermined movement, the preliminary running range for the optical scanning means is varied;

(3) With respect to the optical scanning means effecting a predetermined movement, the timing for starting the scanning of the copy medium is changed in accordance with each magnification desired;

(4) To detect the position of the copy medium and control the timing for starting the scanning of the optical scanning means; and (5) To change the position of the image original on the original carriage in accordance with each magnification desired.

However, the method mentioned under item (1) above would require a number of timers corresponding to the steps of magnification to be provided for controlling the optical scanning means, and these timers would have to be adjusted for each magnification desired.

Also, since the optical scanning means has a certain degree of mass, there would be created a time loss from when the optical scanning means is subjected to a drive until it assumes a constant velocity of movement, namely, till the rising of the scanning means. Where the drive means is a motor or the like, the time loss would be varied by the state of the power source, temperature and frequency of use, and where the drive means is a magnet clutch or the like, the time loss would be varied by the state of the power source and the frequency of use, and it would be nearly impossible to achieve the aforementioned adjustment in the cases including these.

Further, in order to prevent the home position, namely, the preliminary running range, of the scanning means from being varied for each scanning cycle, a mechanism would be required for holding the scanning means at its home position with high accuracy.

The method mentioned under item (2) above would involve, in addition to the above-noted problems, the necessity of providing a complicated mechanism for driving the scanning means to a predetermined position before it starts scanning each time the copying magnification is changed.

The method mentioned under item (3) above would suffer from the drawbacks similar to those noted with respect to the item (1).

The method (4) is almost similar to the method (1) and instead of the timers, a number of copy medium detecting means corresponding to the steps of copy magnification would have to be adjusted.

The method (5) would require the operator of the apparatus to change the position of the image original in accordance with each magnification desired, and this would most undesirably lead to complicated manipulation and accordingly malfunctioning of the apparatus.

SUMMARY OF THE INVENTION

It is therefore an object of the present invention to provide a variable magnification copying apparatus which eliminates the above-noted inconveniences.

It is another object of the present invention to provide such an apparatus which can perform copying with the timing for starting the scanning of the scanning means maintained constant irrespective of changes in copy magnification.

It is still another object of the present invention to provide such an apparatus which can perform copying with the preliminary running range of the scanning means maintained constant irrespective of changes in copy magnification.

It is yet still another object of the present invention to provide such an apparatus which can perform copying with the timing for starting the movement of copy medium with respect to the scanning means maintained constant irrespective of changes in copy magnification.

It is a further object of the present invention to provide such an apparatus which can perform copying by detecting the position of copy medium but without controlling the starting of the scanning of the scanning means.

It is a further object of the present invention to provide such an apparatus which can perform copying without changing the position of an image original placed on an original carriage.

It is a further object of the present invention to provide such an apparatus which can perform copying with the factors such as the position of the image original on the original carriage, the preliminary running range and the timing for starting the scanning of the scanning means, and the timing for starting the movement of copy medium being all maintained identical to those for the 1 × magnification copying even if the velocity of movement of the scanning means is varied to any level.

The invention will become more fully apparent from the following detailed description of some embodiments thereof taken in conjunction with the accompanying drawings.

DESCRIPTION OF THE PREFERRED EMBODIMENTS

Figure 1:
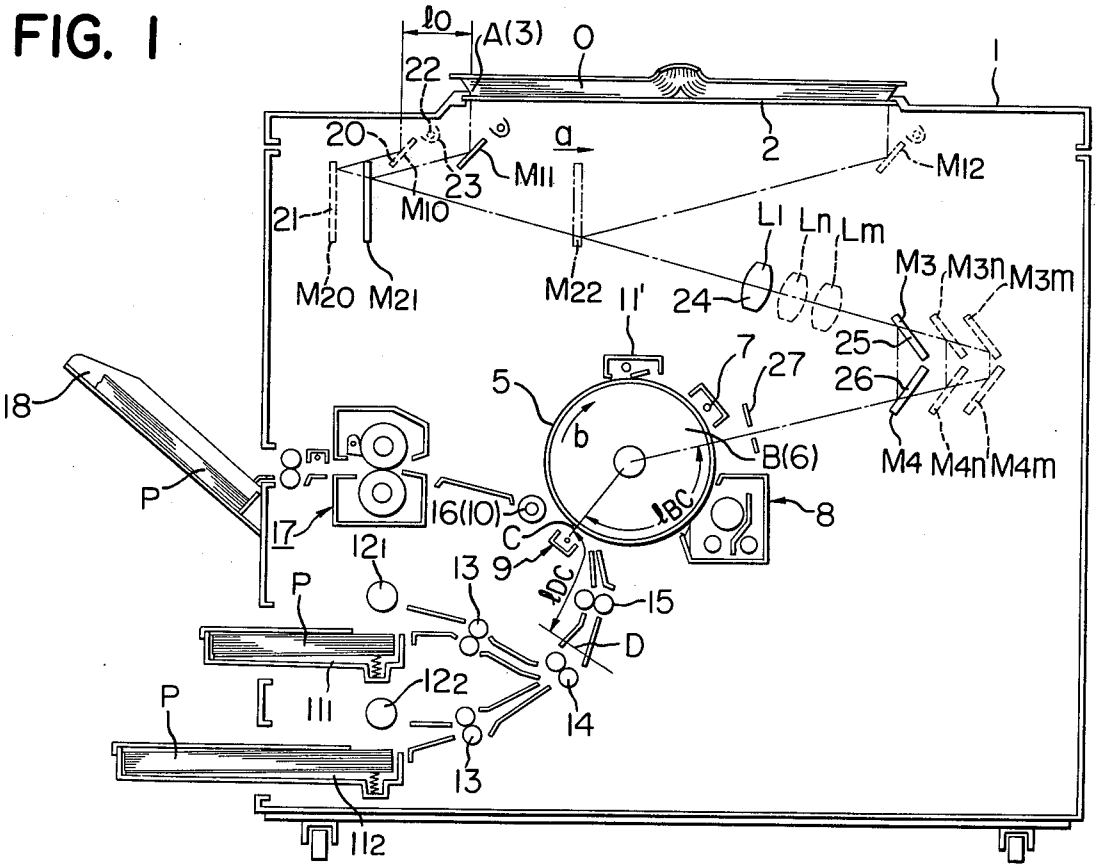
FIG. 1 generally shows the construction of an embodiment of the variable magnification copying apparatus according to the present invention.

Referring to FIG. 1, there is shown an embodiment of the variable magnification copying apparatus according to the present invention which includes an apparatus housing 1, an original carriage 2 formed by a transparent glass plate disposed on top of the housing 1, a first movable mirror 20, a second movable mirror 21, and a tubular light source 22 and reflector 23 which are integrally mounted with the first movable mirror 20. The first movable mirror 20, with the light source 22 and reflector 23, is moved in the direction of arrow *a* in parallelism to the original carriage 2, and the second movable mirror 21 is moved in the same direction as the first movable mirror 20 but at half the velocity of movement of the first movable mirror 20. The first movable mirror 20 and the second movable mirror 21 together constitute optical scanning means. The scanning velocity of this optical scanning means is variable in accordance with a desired copy magnification.

The apparatus further includes a transmission type lens 24 disposed ahead in the path of reflected light from the second movable mirror 21, a third mirror 25, a fourth mirror 26 and an exposure slit 27. The lens 24, the third mirror 25 and the fourth mirror 26 together constitute part of magnification changing means, and these are displaceable to their respective broken-line positions in accordance with a desired copy magnification. When the desired copy magnification is 1x, the lens 24, the third mirror 25 and the fourth mirror 26 are located at solid-line positions L1, M3 and M4, respectively.

Figure 2:
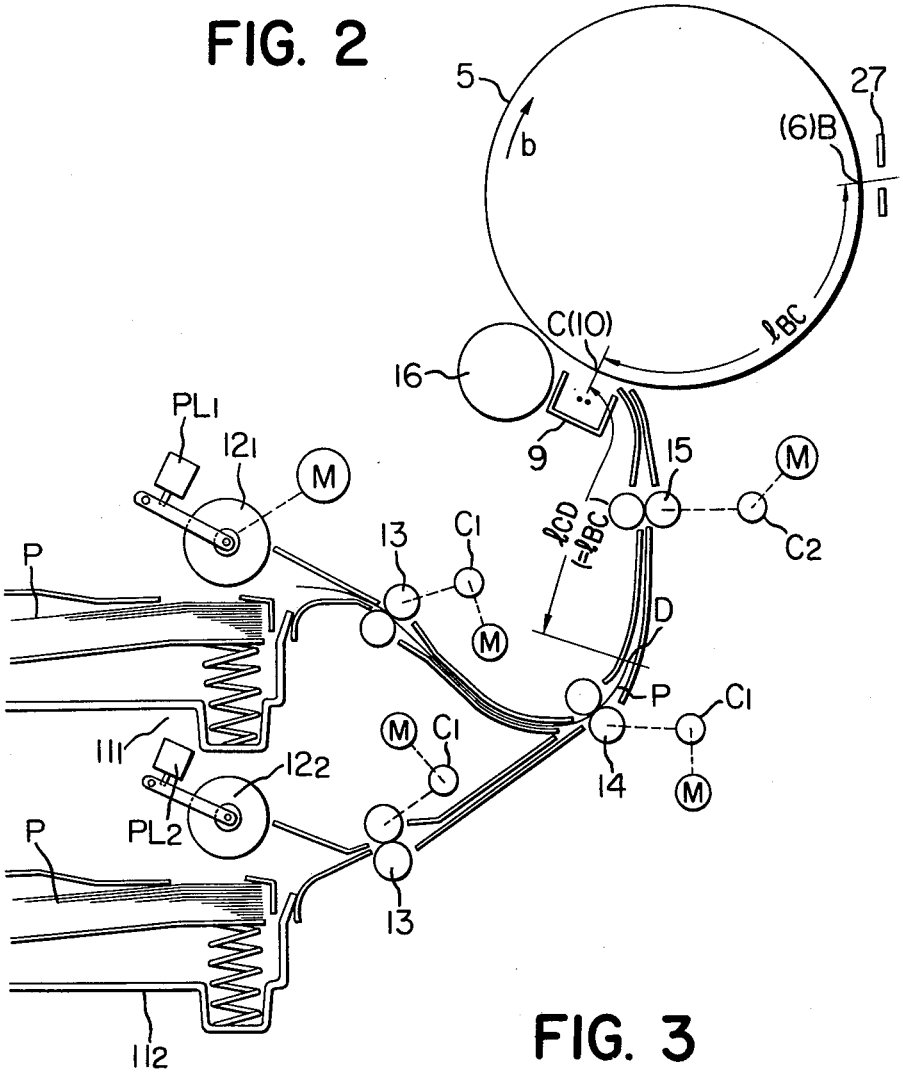
FIG. 2 particularly shows the mechanism for conveying copy medium in FIG. 1.

There is further seen a photosensitive drum 5 rotatable at a predetermined velocity in the direction of arrow *b*, a station 6 whereat the drum 5 is exposed to image light, a charger 7, a developing device 8 containing toner therein, a corona discharger 9 for expediting image transfer, an image transfer station 10 whereat the photosensitive drum 5 is contacted by copying paper P, and a cleaning mechanism 11'. The apparatus is further provided with paper rests (paper supply tables) $11_1$ and $11_2$ mounted in the lower portion of one side of the apparatus housing 1, paper feed rollers $12_1$, $12_2$, a first set of timing rollers 13, a set of intermediate transport rollers 14 and a second set of timing rollers 15. The rests $11_1$ and $11_2$ are loaded with sheets of copying paper (transfer medium) P of different sizes. The paper feed rollers $12_1$ and $12_2$ are coupled to a drive source (not shown) and as shown in FIG. 2, they are respectively displaceable by electromagnetic plungers PL1 and PL2 to a position in which they contact the copying paper on the respective paper rests and to a position in which they do not contact the copying paper (the position shown in FIG. 2). One of the electromagnetic plungers is operable in accordance with a copy size selected.

Referring to FIG. 2, the first set of timing rollers 13 and the intermediate transport rollers 14 are coupled to a drive source M (motor) through a first clutch mechanism C1, and the second set of timing rollers 15 is coupled to the drive source (motor) through a second clutch mechanism C2. The paper feed rollers $12_1$, $12_2$, the first set of timing rollers 13, the intermediate transport rollers 14 and the second set of timing rollers 15 together constitute copying paper conveying means which conveys copying paper at a velocity equal to the velocity of movement of the photosensitive drum 5. The apparatus further includes a copying paper separating mechanism 16, a heat-fixing device 17 and a tray 18 for receiving copying paper P having a copy image formed thereon.

In the copying apparatus of FIG. 1, the image of an image original O illuminated by the light source 22 is scanned by the first movable mirror 20 and the second movable mirror 21 and directed through the lens 24 and via the mirrors 25, 26 to pass through the slit 27 to the photosensitive drum 5 uniformly pre-charged by the charger 7, thus accomplishing the exposure. The original O is placed on the original carriage with one edge of the original registered to the reference position or index 3 on the carriage so that the starting end A of the scanning stroke for the original may always lie at a predetermined position. The latent image formed on the photosensitive drum 5 so exposed is developed by the developing device 8, whereafter the developed image is transferred to copying paper P by the corona discharger 9 at the image transfer station 10.

The paper rests $11_1$ and $11_2$ each loaded with a stock of copying paper are installed in two stages and copying paper may be supplied from either of these rests, as desired. The paper paths from the two rests $11_1$, $11_2$ to the image transfer station 10 are merged into a single path at an intermediate point, and the lengths of these two paths are substantially equal to each other. The paper feed rollers $12_1$, $12_2$ forming part of the copying paper conveying mechanism are normally rotated in their respective positions where they do not contact the stocks of copying paper, and in response to a paper feed signal, one of these paper feed rollers is lowered into contact with the uppermost sheet of the paper stock on an associated one of the paper rests, thus feeding a sheet of copying paper. The copying paper P so fed passes between the first pair of timing rollers 13 located just downstream of the paper rest for preventing oblique movement of the copying paper and correcting the attitude thereof, which timing rollers are designed such that they temporally stop rotating and block the forward movement of the fed copying paper to thereby create a slack in the copying paper and thereafter, resume rotation.

On the other hand, the paper feed roller $12_1$ ($12_2$) is again lifted out of contact with the stock of copying paper in a predetermined time after it was lowered, whereafter the conveyance of the paper is carried out by the first timing rollers and subsequent paper conveying means.

Figure 3:
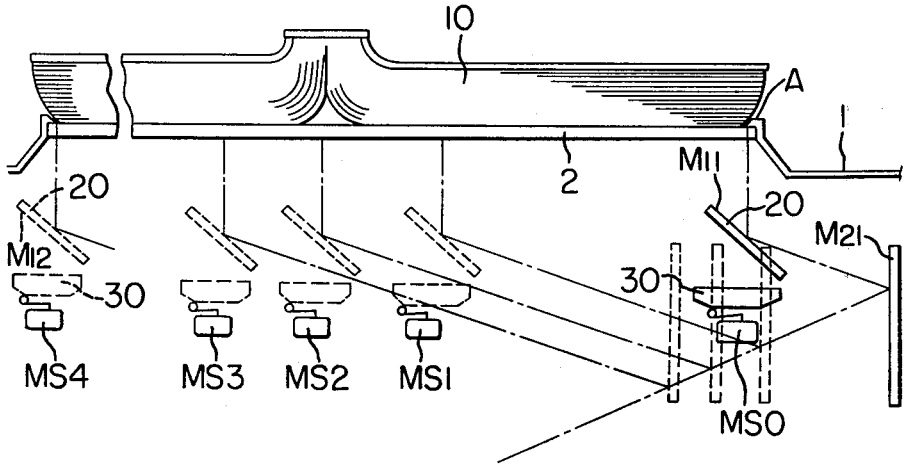
FIG. 3 particularly shows the optical system in FIG. 1.

The copying paper conveyed by the first timing rollers 13 advances along the paper path and through the intermediate transport rollers 14 disposed at the junction of the two paper paths from the upper and lower paper rests, whereafter the paper is stopped at a predetermined position D for the reason which will later be described. That is, the first timing rollers 13 and the intermediate transport rollers 14 are stopped from rotating. The first movable mirror 20 and the second movable mirror 21 forming the optical scanning means start scanning from their home positions M10 and M20 (indicated by broken lines) in FIG. 1 and before these movable mirrors 20 and 21 reach their second positions M11 and M21 (indicated by solid lines) and thus complete the scanning over the preliminary running range $l_0$ which precedes the position for scanning the edge A of the original, the single sheet of copying paper P fed from the rest $11_1$ ($11_2$) has reached its set position D as already noted. When the optical scanning means reaches the edge A of the original, a cam 30 mounted on the first movable mirror 20 as shown in FIG. 3 actuates a microswitch $MS_0$ to generate a signal, by which the first timing rollers 13 and the intermediate transport rollers 14 are restarted to convey the copying paper P which has been temporally stopped. A series of these operations are accomplished by the first clutch mechanism C1 provided on the shaft for transmitting the drive to the first timing rollers 13 and to the intermediate transport rollers 14, and by electromagnetic plungers PL1 and PL2 provided on a member for vertically moving the paper feed rollers $12_1$, $12_2$, and the control of these operations is accomplished by a timer which will later be described. The lengths of the paper paths from the respective paper rests $11_1$ and $11_2$ to the image transfer station 10 are set to equal values, so that irrespective of the upward or downward movement of the rest, the copying paper can be stopped accurately at the predetermined position under the control of the timer.

The restarted copying paper P passes between the second timing rollers 15 disposed short of the image transfer station 10, and then reaches the image transfer station 10, where the copying paper is brought into intimate contact with the image on the photosensitive drum developed in the manner as already described, so that the image is transferred from the photosensitive drum to the copying paper P. After completion of the image transfer, the copying paper is separated from the photosensitive drum by the separating mechanism 16 and conveyed to the heat-fixing device 17 for fixation of the image on the copying paper, whereafter the copying paper is discharged onto the tray 18.

During these steps of the process, the optical scanning means completes the scanning of the predetermined scanning section with the first and second mirrors 20 and 21 having reached their respective reverting positions M12 and M22 (indicated by broken lines) to start the return movement. Simultaneously with initiation of the return movement, a feed signal for copying paper for the next copying cycle is generated by the optical scanning means, whereby the above-described sequence of steps from the paper feed to the paper conveyance is repeated. When the optical scanning means comes back to its home position M10, M20, it again starts to scan the image original.

Where multiple copies are desired, the above-described sequence of steps is repeated in accordance with the number of copies desired.

In the above-described copying apparatus, copying at two steps of reduced magnification can be achieved in addition to the copying at the 1× magnification. If the copying ratio is selected to $1:1/n:1/m$, the scanning velocity of the optical scanning means is $V_1:V_n$ $(=nV_1):V_m$ $(=mV_1)$, where $V_1$ is the scanning velocity for the copying at the 1× magnification. Moreover, in accordance therewith, the lens 24, the third mirror 25 and the forth mirror 26 are movable to their respective positions Ln, Lm, M3n, M3m, M4n, M4m, by a special mechanism (not shown).

When copying is to be effected at each of said magnifications, the times $T_{1l}$, $T_{nl}$ and $T_{ml}$ required for the optical scanning means to scan over its preliminary running range $l_O$ are set so as to satisfy the relation that $T_{1l}>T_{nl}>T_{ml}>T_e$, where $T_e$ is the time required for the illuminating light source to assume its steady state condition.

The invention will now be explained with respect to the apparatus constructed as described above. Assume that the optical scanning means has started scanning from its home position M10, M20 at any of the above-mentioned three velocities $V_1$, $V_n$ $(=nV_1)$ and $V_m$ $(=mV_1)$. Let a point B represent the point on the photosensitive drum whereat the edge A of the image original is imaged on the drum at a point of time whereat the optical scanning means having passed through the preliminary running range $l_O$ has scanned the edge A of the image original. When the point B on the photosensitive drum rotated at the predetermined peripheral velocity $V_1$ has reached a point C corresponding to the image transfer station 10, and if the leading edge of the copying paper P conveyed by the conveyor means reaches the image transfer station 10, then the registration between the leading edge of the copying paper and the leading edge of the copy image on the drum will be established. For various reasons, copying paper is usually conveyed at a velocity equal to the peripheral velocity $V_1$ of the photosensitive drum. Therefore, if, at the point of time whereat the optical scanning means scans the edge A of the image original, the leading edge of the copying paper lies at the set point D which is retrogressive from the image transfer station by a distance corresponding to the distance $l_{BC}$ between the points B and C on the periphery of the photosensitive drum and if the copying paper is conveyed at the velocity $V_1$, then the leading edge of the copying paper and the leading edge of the copy image on the drum will be registered to each other at the image transfer station 10.

Consequently, if the copying paper fed on from the paper rest is temporally stopped at the set point D in advance and if a signal is generated when the optical scanning means has scanned the edge A of the image original, to thereby restart the temporally stopped copying paper by the signal, then the registration between the leading edge of the copy image and the leading edge of the copying paper may be easily and perfectly realized irrespective of any scanning velocity of the optical scanning means.

Figure 9:
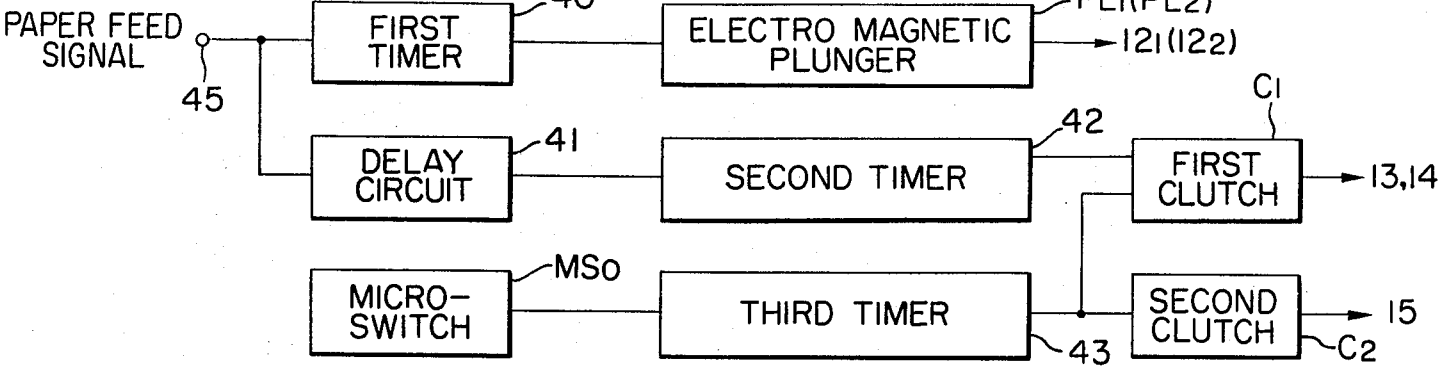
FIG. 9 is a block diagram of an embodiment of the drive control circuit.

FIG. 9 shows, in block diagram, the drive control circuit for the copying paper conveying means. In this Figure, reference character 40 designates a first timer, 41 a delay circuit, 42 a second timer and 43 a third timer.

A paper feed signal is supplied to a terminal 45. This paper feed signal is generated, for example, by the cam 30 on the first mirror 20 actuating the microswitch MS4 when the optical scanning means has reached its reverting position M12, M22. However, this is not the only possible way to generate the paper feed signal but other various methods may be used to generate such signal. When the paper feed signal is supplied to the terminal 45 upon closing of the microswitch MS4, the first timer 40 and the delay circuit 41 are operated. Upon operation of the first timer 40, the electromagnetic plunger PL1 (PL2) is energized to lower the paper feed roller $12_1$ ($12_2$) onto the stock of copying paper, thus feeding a sheet of copying paper P from the paper rest $11_1$ ($11_2$).

When the forward movement of the leading edge of the copying paper is blocked by the first timing rollers 13 so that the copying paper becomes warped in its path, the second timer 42 is operated by the delay circuit 41. Upon operation of the second timer 42, the drive is transmitted through the first clutch mechanism C1 to the first timing rollers 13 and the intermediate transport rollers 14, so that the copying paper has its attitude corrected by the first timing rollers 13 and is conveyed thereby. As soon as the copying paper P has been nipped between the first pair of timing rollers 13, the first timer 40 becomes inoperative. When the leading edge of the copying paper P reaches the set position D, the second timer 42 becomes inoperative and the copying paper is stopped. Subsequently, the optical scanning means starts scanning and reaches the edge A of the image original, whereupon the cam 30 on the first mirror 20 closes the microswitch $MS_0$ to thereby operate the third timer 43. Upon operation of the third timer 43, the drive is transmitted through the first C1 and the second clutch C2 to the first timing rollers 13, the intermediate transport rollers 14 and the second timing rollers 15, whereby the copying paper is again conveyed.

Since, as already noted, the distance of movement $l_{BC}$ of the photosensitive drum between the exposure station 6 and the image transfer station 10 is equal to the distance of movement of the copying paper between the set position D and the image transfer station 10, the leading edge of the copy image formed on the photosensitive drum and the leading edge of the copying paper P are registered to each other at the image transfer station 10 irrespective of the change in the scanning velocity, thereby ensuring a proper copy image to be formed on the copying paper P.

Figure 4:
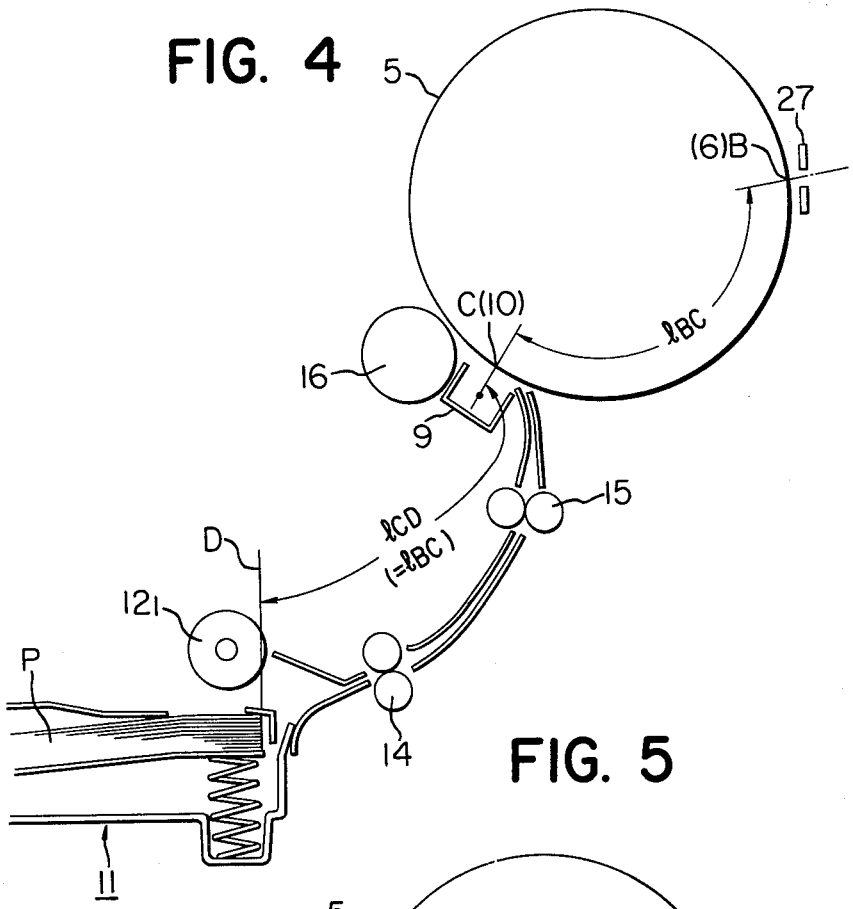
FIGS. 4 to 8 show the constructions of essential portions of further embodiments of the present invention.
Figure 5:
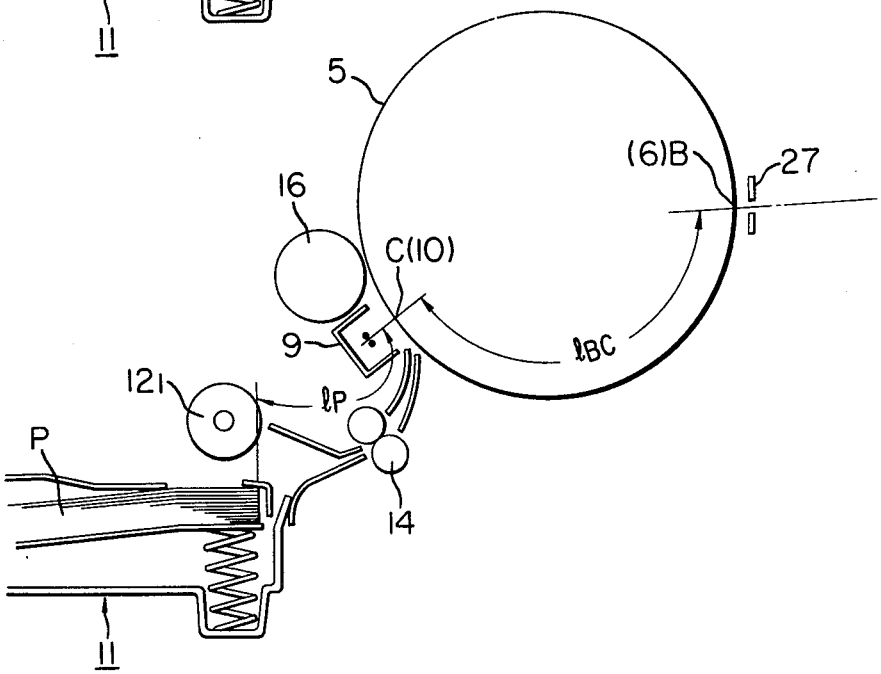

In FIGS. 1 and 2, the two paper paths from the two paper rests $11_1$, $11_2$ to the image transfer station 10 are equal to each other but longer than the distance $l_{BC}$ between the points B and C on the periphery of the photosensitive drum, whereas this is not restrictive but, as shown in FIG. 4, the paper rests 11 may be disposed at a position corresponding to the set position D in the paper path, namely, such a position that the entire length of the paper path is equal to the aforementioned distance $l_{BC}$. As a further alternative, the entire length of the paper path may be shorter than said distance $l_{BC}$, as shown in FIG. 5. In the case of FIG. 4, the feeding of copying paper P from the paper rest 11 may be started at the point of time whereat the optical scanning means has scanned the edge A of the image original. In the case of FIG. 5, the feeding of copying paper P from the paper rest 11 may be started with a time delay $t = (l_{BC} - l_P)/V_1$ provided by the timer with respect to the signal generated when the optical scanning means has scanned the edge A of the image original, said time delay $t$ being the time required for the copying paper to pass at the predetermined velocity $V_1$ through a path corresponding to the difference $(l_{BC} - l_P)$ between the entire length $l_P$ of the aforementioned paper path ($l_P < l_{BC}$) and the aforementioned distance $l_{BC}$.

Further, where a plurality of copying paper rests are installed, the lengths of the paper paths from the respective paper rests to the image transfer station 10 need not always be equal to one another as shown in the embodiment of FIGS. 1 and 2, but for example, the lengths of the paper paths from the paper rests $11_1$, $11_2$, $11_3$ to the image transfer station may differ from one another to obtain the same operational effect as that obtained by the embodiment of FIGS. 1 and 2, provided that the distance $l_{CD}$ between the temporary stop position or the set position D of the copying paper from each of the paper rests and the image transfer station is made equal to the aforementioned distance $l_{BC}$ on the photosensitive drum.

Figure 6:
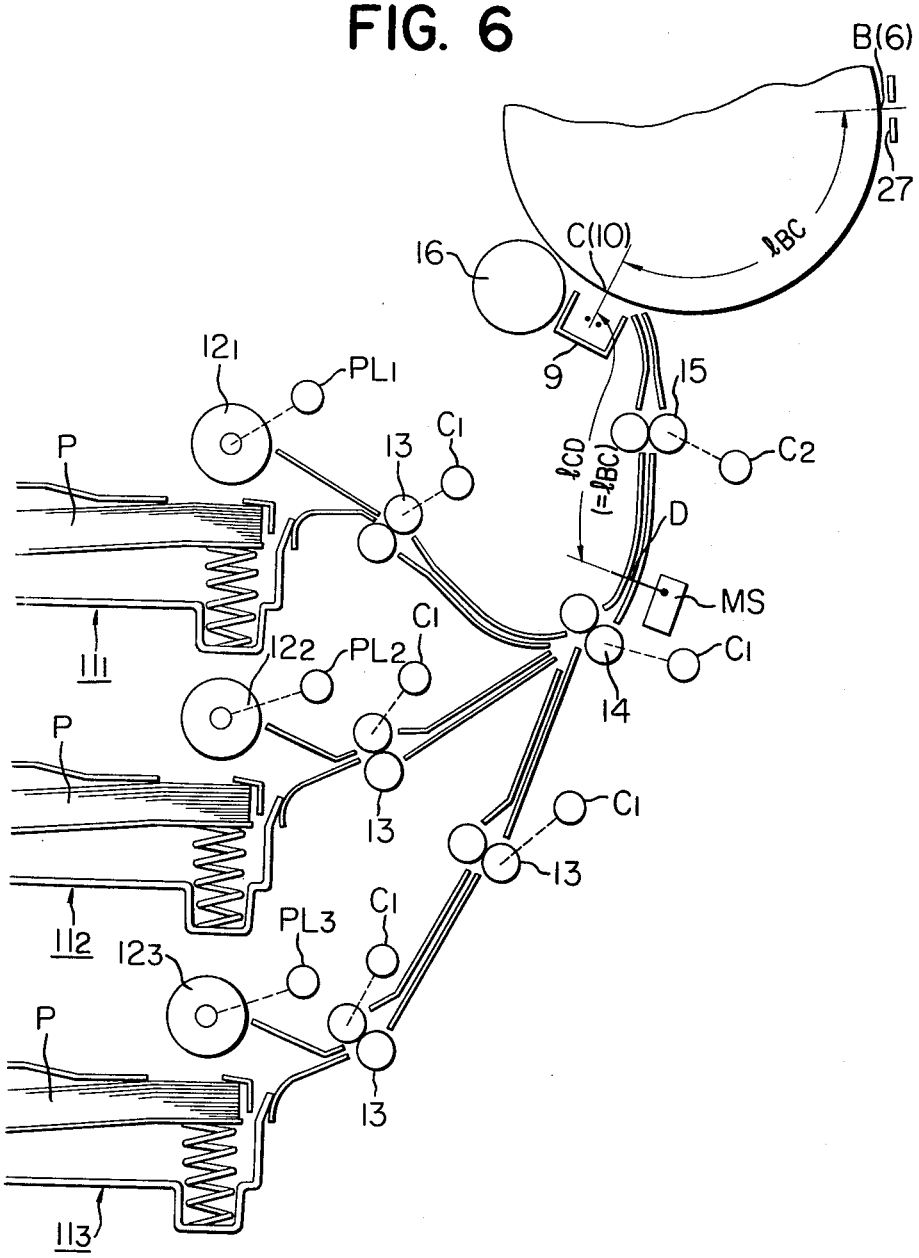

In the embodiment of FIG. 6, a micromotion microswitch MS as the means for temporally stopping the copying paper at the set position D is installed at the set position D in the paper path to detect the leading edge of the copying paper.

Figure 10:
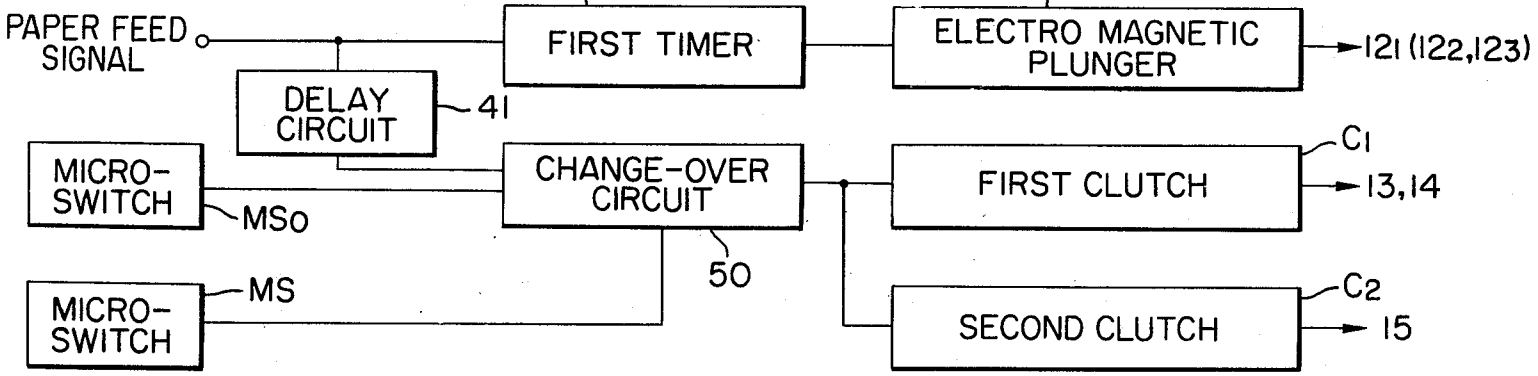
FIG. 10 is a block diagram of another embodiment of the drive control circuit.

FIG. 10 is a block diagram of the drive control circuit for the copying apparatus of FIG. 6. In this Figure, the elements identical to those in FIG. 9 are designated by identical reference characters. In FIG. 10, the reference numeral 50 denotes a change-over circuit which may comprise a flip-flop, for example.

When a paper feed signal is supplied from the terminal 45, the electromagnetic plunger PL1 (PL2, PL3) is energized by the first timer 40 to feed a sheet of copying paper P. When a signal is supplied from the delay circuit 41, the change-over circuit 50 is changed over to operate the first and second clutch mechanisms $C_1$ and $C_2$ to convey the copying paper P. As soon as the leading edge of the copying paper P is detected by the microswitch MS, the change-over circuit 50 is changed over to render the first and second clutch mechanisms inoperative, thus stopping the copying paper P. Subsequently, the microswitch $MS_0$ is closed, whereupon the change-over circuit 50 is again changed over to operate the first and second clutch mechanisms C1 and C2, whereby the copying paper P is again conveyed.

The means for temporally stopping the copying paper is not restricted to the shown example but may be the detection method using ultrasonic wave or the detection method using both a light emitting element and a light receiving element. As a further alternative, a timer may be used for each of the paper rests so as to vary the distance over which the copying paper is initially fed from each paper rest to the aforementioned set position D. Of course, any of these methods is equally applicable in the other embodiments.

In the above-described embodiment, either detector means using a micromotion microswitch or the like for detecting the position of the copying paper or a timer set so as to feed the copying paper by a predetermined distance from the paper rest is used to temporally stop the copying paper at the set position D. However, for example, where a microswitch or the like is employed in the path of copying paper, the stop position of the copying paper may be varied by the self-supporting strength of the copying paper itself, and even where a timer or the like is employed, the operation of the timer may not always be uniform every time and second registration means will have to be provided if it is desired to provide a more accurate registration.

Figure 7:
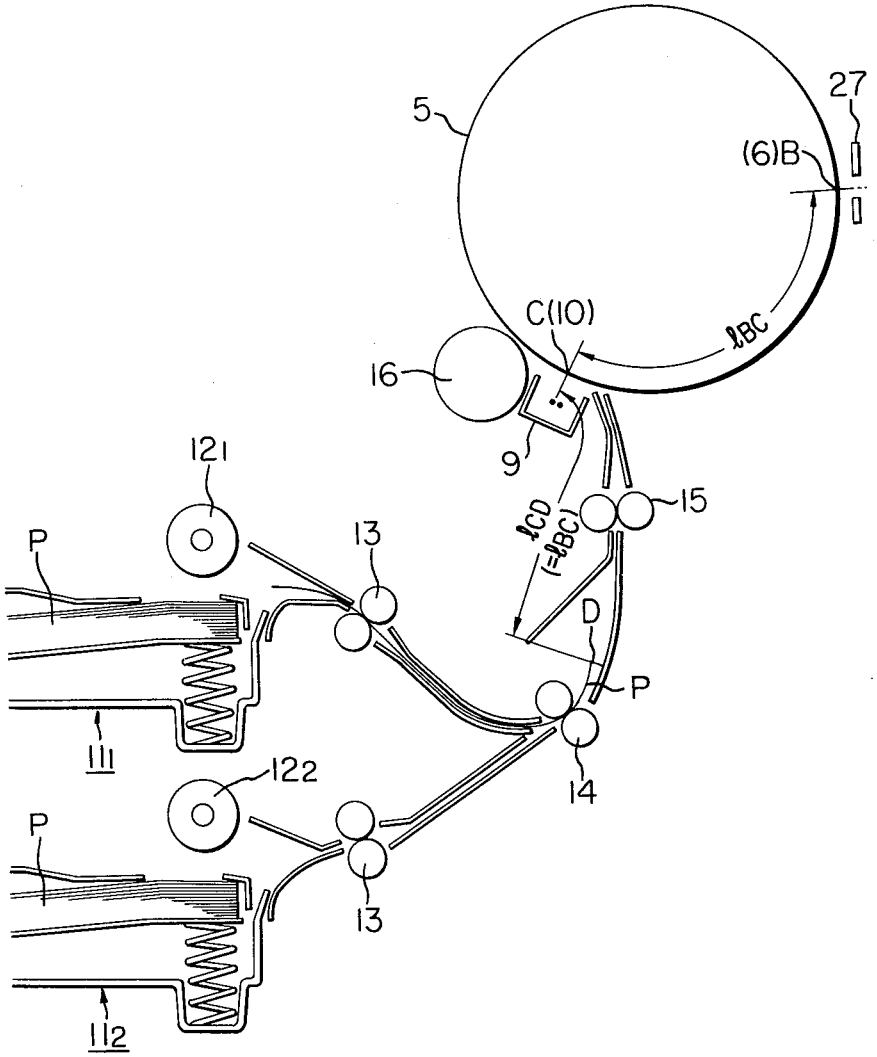

FIG. 7 shows an embodiment in which a second set of timing rollers is disposed at a location in the paper path as nearest as possible to the image transfer station.

The second timing rollers 15 are functionally similar to the first timing rollers 13. That is, the second timing rollers are designed to temporally stop rotating a moment before the arrival of copying paper to thereby block the forward movement of the leading edge of the copying paper and create a slack in the copying paper, and thereafter resume rotation, thus eliminating the problem noted above, and the second timing rollers have the function of performing the final delicate registration immediately before the image transfer station.

The signal for controlling the second timing rollers 15 may be produced, for example, by the optical scanning means in the manner as shown in FIG. 3. In this case, the second timing rollers may be designed such that they stop rotating as long as the cam 30 attached to the first mirror 20 of the optical scanning means scans over the microswitch MS1, MS2 or MS3 in accordance with the copying magnification desired.

Figure 8:
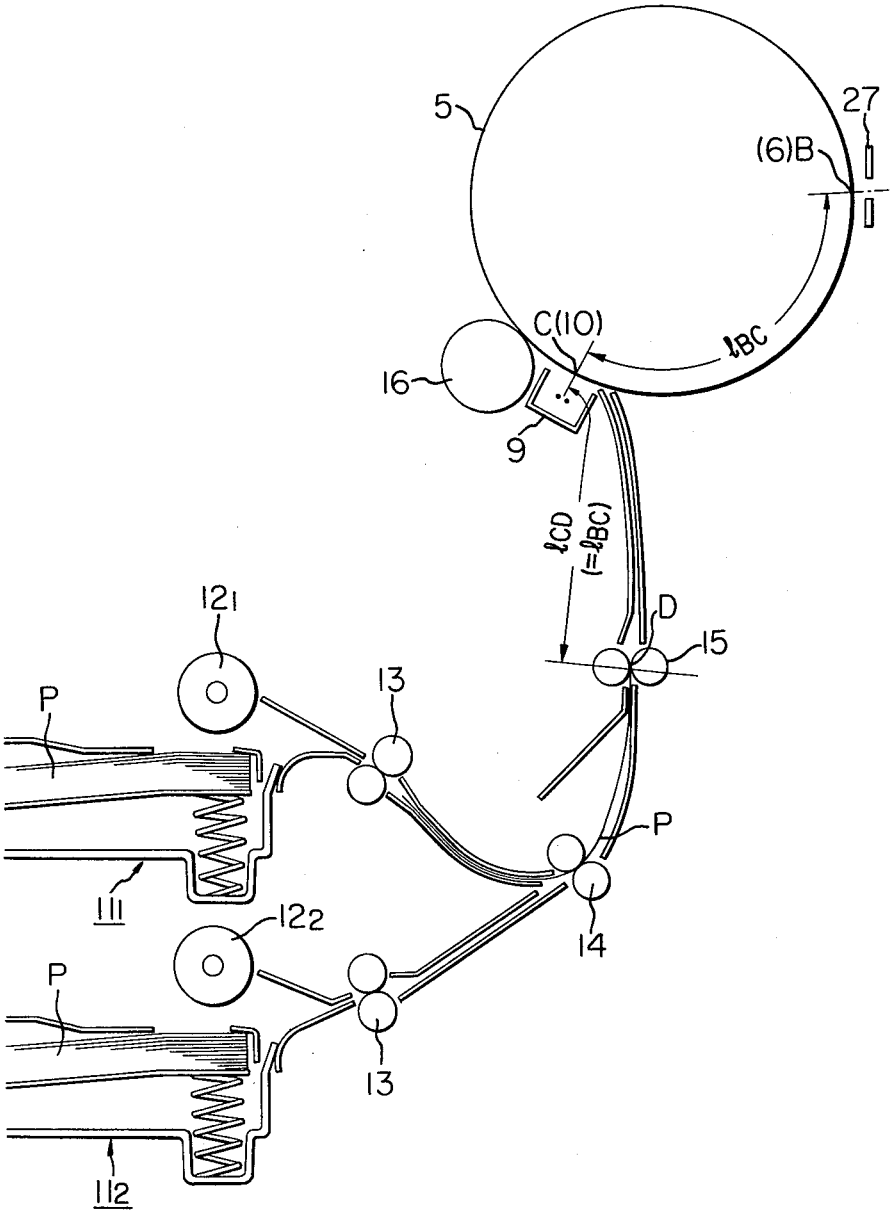

As an alternative, where the distance $l_{BC}$ between the points B and C on the photosensitive drum is relatively short as shown in FIG. 8, the second timing rollers 15 may be installed at the aforementioned set position D which is at a distance from the image transfer station 10 equal to the aforementioned distance $l_{BC}$, whereby registration may be achieved with a relatively high accuracy.

According to the present invention, as has hitherto been described, registration between the leading edge of the copy image and the leading edge of the copying paper can be achieved simply by detecting the point of time whereat the optical scanning means scans the edge of the image original, irrespective of the number of the position of the copying paper rests and irrespective of any scanning velocity of the optical scanning means. Moreover, the present invention can perform a reliable and stable function without being affected by the unstabilizing factors in the rising portion of the stroke of the optical scanning means.

Although the mirrors 20 and 21 forming the optical scanning means have been shown as movable, these mirrors may be made stationary while the original carriage may be constructed as movable to scan at a velocity in accordance with a desired magnification.

What we claim is:

1. A variable magnification copying apparatus comprising:

an index for aligning an edge of an original to be copied, said index being usable irrespective of magnification;

a photosensitive member movable sequentially past an image exposure station, then an image developing station and then an image transfer station at a constant peripheral speed irrespective of magnification;

scanning means movable along a predetermined path to optically scan the original, wherein the scanning velocity of said scanning means varies in inverse proportion to a selected copy magnification;

image forming means for projecting onto said photosensitive member at said image exposure station a light image of the original scanned by said scanning means at a speed corresponding to the selected magnification to form an electrostatic latent image thereon of the selected magnification;

developing means for developing the electrostatic latent image into a developed image at said developing station;

means for conveying copy material to said transfer station;

transfer means for transferring the developed image onto a copy material at said transfer station;

detecting means for detecting the position of said scanning means and for producing a signal when said scanning means reaches a position where it substantially scans the edge of the original; and means coupled to said detecting means for controlling said conveying means in response to said signal to ensure that the leading edge of the developed image on said photosensitive medium registers with the leading edge of the copy material irrespective of the selected copying magnification.

2. An apparatus according to claim 1, wherein said scanning means includes first reflecting means movable in parallel with the original to be copied and at a speed obtained by multiplying the peripheral speed of said photosensitive member by the reciprocal of the selected magnification, and second reflecting means movable in the same direction as said first reflecting means but at a speed which is one half the speed of said first reflecting means.

3. An apparatus according to claim 2, wherein said detecting means includes a switch actuatable by movement of said scanning means, said switch being turned on when said scanning means reaches the position where it substantially scans the one edge of the original.

4. An apparatus according to claim 1, wherein said conveying means is provided with means for correcting the orientation of the copy material being fed.

5. An apparatus according to claim 4, wherein said storing means stores copy materials of different sizes at different predetermined positions, and wherein the distances from the preset position to the different predetermined positions are substantially the same.

6. A variable magnification copying apparatus comprising:

an index for aligning an original to be copied, said index being commonly usable irrespective of magnification;

a photosensitive member movable sequentially past an image exposure station, then an image developing station and then an image transfer station, and at a constant peripheral speed irrespective of magnification;

scanning means for optically scanning the original as it moves along a predetermined path from a home position past a scan starting position to a scan ending position wherein the scanning velocity of said scanning means is variable in inverse proportion to a selected copy magnification;

image forming means for projecting onto said photosensitive member at said image exposure station a light image of the original being scanned by said scanning means at a speed corresponding to the selected magnification to form an electrostatic latent image thereon of the selected magnification;

developing means for developing the electrostatic latent image into a developed image at said developing station;

means for storing at a predetermined position copy material to be fed to said transfer station;

means for feeding the copy material one by one to said transfer station along a predetermined path;

transfer means for transferring the developed image onto a copy material at said transfer station;

first control means for controlling said feeding means to start the feeding operation of said feeding means before said scanning means, moving from its home position, reaches the scan starting position, and to stop the copy material with its leading edge placed at a preset position along the predetermined path;

detecting means for detecting the position of said scanning means and for producing a signal when said scanning means reaches a position where it substantially scans an edge of the original; and second control means for resuming the operation of said feeding means in response to the signal produced by said detecting means to feed the copy material from the preset position to the transfer station so that the leading edge of the developed image of said photosensitive medium registers with the leading edge of the copy material.

7. An apparatus according to claim 6, wherein the distance between said exposure station and said transfer station measured along the path movement of the periphery of said photosensitive member is substantially equal to the distance between the preset position and the transfer station measured along the path of movement of the copy material, and wherein said feeding means moves the copy material at a speed substantially equal to the peripheral speed of said photosensitive member at least along the part of the predetermined path extending from the preset position to said transfer station.

8. An apparatus according to claim 6, wherein said first control means includes timing means for producing a signal for stopping the operation of said feeding means before the leading edge of the copy material reaches the preset position.

9. An apparatus according to claim 6, wherein said first control means includes means for detecting the position of said copy material along the predetermined path, said position detecting means producing a signal for stopping the operation of said feeding means when the leading edge of the copy material reaches the preset position.

10. An apparatus according to claim 6, wherein said storing means stores copy materials of different sizes at different predetermined positions, and wherein the distances from the preset position to the different predetermined positions are substantially the same.

11. An apparatus according to claim 6, wherein said feeding means is provided with means for correcting the orientation of the copy material being fed, said correcting means including a member which engages the copy material.

12. A variable magnification copying apparatus comprising:

an index for aligning an edge of an original to be copied, said index being usable irrespective of magnification;

a photosensitive member movable sequentially past an image exposure station, then an image developing station and then an image transfer station and at a constant peripheral speed irrespective of magnification;

scanning means movable along a predetermined path to optically scan the original, wherein the scanning velocity of said scanning means varies in inverse proportion to a selected copy magnification;

image forming means for projecting onto said photosensitive member at the image exposure station a light image of the original being scanned by said scanning means at a speed corresponding to the selected magnification to form an electrostatic latent image thereon of the selected magnification;

developing means for developing the electrostatic latent image into a developed image at said developing station;

holding means for holding copy materials to be fed to said transfer station;

means including means for feeding the copy material out of said holding means for conveying the copy material along a predetermined path to said transfer station at a speed substantially equal to the peripheral speed of said photosensitive member, wherein the distance from said holding means to said transfer station measured along the predetermined path of said feeding means is substantially equal to the distance from said image exposure station to said image transfer station measured along the path of movement of the peripheral surface of said photosensitive member;

transfer means for transferring the developed image onto a copy material at said transfer station;

detecting means for detecting the position of said scanning means and for producing a signal when said scanning means reaches a position where it substantially scans the edge of the original; and means for actuating said conveying means in response to the signal produced by said detecting means.

13. An apparatus according to claim 12, wherein said holding means includes means for storing a number of different sizes of copy material at different predetermined positions.

14. A variable magnification copying apparatus comprising:

an index for aligning an edge of an original to be copied, said index being usable irrespective of magnification;

a photosensitive member movable sequentially past an image exposure station, then an image developing station and then an image transfer station and at a constant peripheral speed irrespective of magnification;

scanning means movable along a predetermined path to optically scan the original, wherein the scanning velocity of said scanning means varies in inverse proportion to a selected copy magnification;

image forming means for projecting onto said photosensitive member at the image exposure station a light image of the original being scanned by said scanning means at a speed corresponding to the selected magnification to form an electrostatic latent image thereon of the selected magnification;

developing means for developing the electrostatic latent image into a developed image at said developing station;

holding means for holding copy materials to be fed to said transfer station;

means, holding means for feeding the copy material out of said holding means, for conveying the copy material along a predetermined path to said transfer station at a speed substantially equal to the peripheral speed of said photosensitive member, wherein the distance from said holding means to said transfer station, measured along the predetermined path of said conveying means is less than the distance from said image exposure station to said image transfer station measured along the path of movement of the peripheral surface of said photosensitive member;

transfer means for transferring the developed image onto a copy material at said transfer station;

detecting means for detecting the position of said scanning means and for producing a signal when said scanning means reaches a position where it substantially scans the edge of the original; and control means, responsive to the signal produced by said detecting means, for actuating said conveying means after a time interval defined by $\Delta l/V$ after the signal is produced, where $\Delta l$ is the difference between the distance from said holding means to said transfer station and the distance from said image exposure station to said image transfer station, and V is the peripheral speed of said photosensitive member.

15. An apparatus according to claim 14, wherein said holding means includes means for storing a number of different sizes of copy material at different predetermined positions.

16. A variable magnification copying apparatus comprising:

a photosensitive member movable sequentially past an image exposure station, then an image developing station and then an image transfer station at a constant peripheral speed irrespective of magnification;

scanning means for scanning an original to be copied, said scanning means having its scanning velocity variable in inverse proportion to a selected copy magnification;

image forming means for projecting onto said photosensitive member at said image exposure station a light image of the original scanned by said scanning means at a speed corresponding to the selected magnification to form an electrostatic latent image thereon of the selected magnification;

developing means for developing the electrostatic latent image into a developed image at said developing station;

means for conveying copy material to said transfer station;

transfer means for transferring the developed image onto a copy material at said transfer station;

detecting means for detecting that said scanning means substantially scans the edge of the original; and means coupled to said detecting means for controlling said conveying means in response to said detecting means to ensure that the leading edge of the developed image on said photosensitive medium registers with the leading edge of the copy material irrespective of the selected copying magnification.

* * * * *

UNITED STATES PATENT OFFICE

CERTIFICATE OF CORRECTION

Patent No. 4,129,377 Dated December 12, 1978

Inventor(s) KOICHI MIYAMOTO, ET AL

It is certified that error appears in the above-identified patent and that said Letters Patent are hereby corrected as shown below:

Column 13, line 12, "means, holding" should read --means, including--.

Signed and Sealed this

*Eleventh* Day of *December 1979*

[SEAL]

*Attest:*

SIDNEY A. DIAMOND

*Attesting Officer* *Commissioner of Patents and Trademarks*